US011111659B2

(12) United States Patent
DesErmia

(10) Patent No.: US 11,111,659 B2
(45) Date of Patent: Sep. 7, 2021

(54) DELAY TIMER FOR THE DELAYED FLUSHING OF A TOILET

(71) Applicant: Adam DesErmia, Tega Cay, SC (US)

(72) Inventor: Adam DesErmia, Tega Cay, SC (US)

( * ) Notice: Subject to any disclaimer, the term of this patent is extended or adjusted under 35 U.S.C. 154(b) by 34 days.

(21) Appl. No.: 16/677,554

(22) Filed: Nov. 7, 2019

(65) Prior Publication Data

US 2021/0140159 A1 May 13, 2021

(51) Int. Cl.
*E03D 5/10* (2006.01)
*E03D 5/094* (2006.01)

(52) U.S. Cl.
CPC ..... *E03D 5/10* (2013.01); *E03D 5/094* (2013.01)

(58) Field of Classification Search
CPC ..... E03D 5/10; E03D 5/12; E03D 5/094
USPC ..... 4/406
See application file for complete search history.

(56) References Cited

U.S. PATENT DOCUMENTS 3,090,967 A 5/1963 Erhardt
3,334,359 A * 8/1967 Weingartner ..... E03D 5/10 4/325
4,014,050 A 3/1977 Goldsworthy
4,052,756 A 10/1977 Whiteman, Sr. et al.
4,058,858 A * 11/1977 Che-Wei ..... E03D 1/142 4/324
4,152,794 A 5/1979 Pan
4,412,362 A 11/1983 Nylund
5,026,021 A 6/1991 Pino
6,061,843 A 5/2000 Rump et al.
6,250,601 B1 6/2001 Kolar et al.
6,321,395 B1 11/2001 Parsons et al.
6,332,229 B1 12/2001 OMalley et al.
7,293,583 B2 * 11/2007 Arigoni ..... E03D 5/10 137/624.11
7,415,737 B2 * 8/2008 Hung ..... E03D 5/105 4/302
7,731,154 B2 6/2010 Parsons et al.
8,387,172 B2 3/2013 Nasrallah
8,955,822 B2 2/2015 Parsons et al.
2005/0076425 A1 * 4/2005 Contadini ..... E03D 5/09 4/405
2013/0174338 A1 7/2013 Nasrallah

* cited by examiner

*Primary Examiner* — Huyen D Le
(74) *Attorney, Agent, or Firm* — Jeffrey C. Watson; Mathew L. Grell; Grell & Watson Patent Attorneys LLC

(57) ABSTRACT

A delay timer for the delayed flushing of a toilet includes a timer mechanism, an external switch, and a retracting device. The external switch is in communication with the timer mechanism. The retracting device has a retractable line and is in communication with the timer mechanism. The retractable line is configured to be connected to a chain or a flapper in a tank of the toilet for flushing the toilet. Wherein, when the external switch is activated, the timer mechanism is configured to delay a set period of time and then communicate with the retracting device to retract the retractable line to flush the toilet after the set period of time from when the external switch was activated.

20 Claims, 7 Drawing Sheets

DELAY TIMER FOR THE DELAYED FLUSHING OF A TOILET

FIELD OF THE DISCLOSURE

The present disclosure relates to toilets, urinals or the like, and mechanisms for flushing of toilets, urinals, or the like. More specifically, the present disclosure is directed to a delay timer for the delayed flushing of toilets, urinals, or the like for delaying the flushing of the toilet, urinal, or the like, for a set period of time.

BACKGROUND

A toilet is a piece of hardware used for the collection or disposal of human urine and feces. Toilets are commonly made of ceramic (porcelain), concrete, plastic, or wood. In private homes, the toilet, sink, bath, or shower may be in the same room. Another option is to have one room for body washing (bathroom) and another for the toilet and hand-washing sink (toilet room). Public toilets consist of one or more toilets, and commonly urinals, which are available for use by the general public. Toilets can be with or without flushing water (flush toilet or dry toilet). They can be set up for a sitting posture or for a squatting posture (squat toilet). Flush toilets are usually connected to a sewer system in urban areas and to septic tanks in less built-up areas. Dry toilets are connected to a pit, removable container, composting chamber, or other storage and treatment device. The instant disclosure may be directed toward a delay timer for use with flush toilets in public facilities or in private homes.

Currently there are no toilets or products that allow the user to delay the flushing process of the toilet or urinal. All of the current flushing switches and mechanisms allow for an immediate flush only, without a delay. However, because of the desire to delay the noise of flushing the toilet, like during the middle of the night or while a baby is sleeping, or to consolidate flushes and conserve water, there is clearly a need to provide a means and mechanism to delay the flushing of a toilet.

In addition, the instant disclosure also recognizes that currently there are also no toilets or products that allow the user to automatically flush the toilet on a set frequency. This may be desirable for toilets that are less frequently used, like vacation homes or rental properties, where there may be a desire to automatically flush the toilet every so often (every day, every week, every month, the like, etc.) to prevent toilet bowl ring to keep the toilet clean and/or to prevent the pipes from freezing in the vacation home, rental property, or the like.

Furthermore, the instant disclosure also recognizes that currently there is no means or devices to remotely flush or monitor a toilet, urinal, or the like. For example, a user may want the option to remotely flush a rental home or vacation home toilet, urinal or the like on demand from a remote location, like during deep freezes or known vacancies. As another example, a user may want to remotely monitor the flushing of the toilet, urinal, or the like.

The instant disclosure may be designed to address at least certain aspects of the problems discussed above by providing of a delay timer for the delayed flushing of a toilet.

SUMMARY

In accordance with at least selected embodiments, the instant disclosure may address at least certain aspects of the above mentioned needs, issues and/or problems and may provide a delay timer for the flushing of toilets. The delay timer for the flushing of toilets may include a timer mechanism, an external switch, and a retracting device. The external switch may be in communication with the timer mechanism. The retracting device may have a retractable line and may be in communication with the timer mechanism. The retractable line may be configured to be connected to a chain or a flapper in a tank of the toilet for flushing the toilet. Wherein, when the external switch is activated, the timer mechanism may be configured to delay a set period of time and then communicate with the retracting device to retract the retractable line to flush the toilet after the set period of time from when the external switch was activated.

In select embodiments of the disclosed delay timer for delayed flushing of a toilet, the external switch may communicate with the timer mechanism via a wire.

One feature of the disclosed delay timer for delayed flushing of a toilet may be that the external switch can include a lighted push button. The lighted push button may be configured to light up when pushed. This lighting up feature when pushed may be to verify the external switch has been pressed and the timer mechanism has begun delaying the set period of time to automatically flush the toilet.

In select embodiments of the disclosed delay timer for delayed flushing of a toilet, the external switch may be incorporated into a handle configured for flushing the toilet. The handle may include a conduit for connecting a wire from the external switch on a front of the handle through a pivot connection of the handle to a hole in the tank for connecting the handle. As such, the wire may extend from the external switch on the front of the handle, through the conduit in the handle and out of the pivot connection of the handle through the hole in the tank, to the inside of the tank and to the timer mechanism.

Another feature of the disclosed delay timer for delayed flushing of a toilet may be that the retractable line can include a clip. The clip may be positioned at a distal end of the retractable line. The clip may be configured to connect to a link of the chain connected to the flapper.

In select embodiments of the disclosed delay timer for delayed flushing of a toilet, the timer mechanism and the retracting device may be housed in a control unit. The control unit may be configured to be positioned inside the tank of the toilet. In select embodiments, the control unit may be configured to be hung on a back inner wall of the tank of the toilet via at least one bracket. Each of the at least one brackets may include a hook portion. The hook portion may be connected to the control unit and may extend from an inside of the tank on the back inner wall of the tank, over a top of the tank beneath a lid of the tank, and down an outside of the tank on a back outer wall of the tank.

Another feature of the disclosed delay timer for delayed flushing of a toilet may be that the control unit can include a plastic housing. The plastic housing may be configured to seal the timer mechanism and the retracting device inside the control unit.

In select embodiments of the disclosed delay timer for delayed flushing of a toilet, the control unit may include batteries. The batteries may be configured for powering the timer mechanism and the retracting device.

In select other embodiments of the disclosed delay timer for delayed flushing of a toilet, the control unit may include a wired power source. The wired power source may be configured for powering the timer mechanism and the retracting device.

In select other embodiments of the disclosed delay timer for delayed flushing of a toilet, the control unit may include a counterweight. The counterweights may be configured for powering the timer mechanism and the retracting device via flow of the water entering the tank of the toilet to spin a gear system, wherein the mechanical energy of the gears or counterweight are used to create the delay of the set period of time of the timer mechanism.

In select embodiments of the disclosed delay timer for delayed flushing of a toilet, the retracting device may include a reel. The reel may be powered by an electric motor to retract the retractable line to flush the toilet. In select embodiments, the electric motor may also be configured to allow the retractable line to extend out from the reel of the retracting device after the toilet has been flushed.

Another feature of the delay timer for the delayed flushing of a toilet may be that the timer mechanism can also be configured to automatically communicate to the retracting device to retract the line after a set frequency of flush, like once a day, once a week, once a month, the like, etc. Wherein, the delay timer may be configured for automatically flushing the toilet the set frequency of flush, including, but not limited to, being configured for automatically flushing the toilet once a day, once a week, once a month, the like, etc., or any other desired frequency of flush.

Another feature of the delay timer for the delayed flushing of a toilet may be that the control unit may include a wireless communication device. The wireless communication device may be adapted to establish a wireless connection between the timer mechanism and a remote device, like a cell phone, tablet, computer, the like, etc. for wirelessly communicating with the remote device, like via Wi-Fi, Bluetooth®, cellular, the like wireless communications, etc. Whereby, the wireless communication device may allow a user to remotely flush the toilet and/or to program the delay timer for the desired set period of time and/or desired frequency of flush. The wireless communication device may also allow a user to monitor the delay timer.

In another aspect, the instant disclosure embraces the delay timer for the delayed flushing of a toilet including any various embodiments or combination of embodiments shown and/or described herein, including the combination of all elements or embodiments shown and/or described herein.

In another aspect, the instant disclosure embraces a toilet with the delay timer for the delayed flushing of the toilet disclosed herein. The toilet may include any of the various embodiments of the delay timer for the delayed flushing of a toilet described and/or shown herein. As such, the toilet with delayed flushing may generally include a tank with a handle, and a lever in communication with the handle for raising a flapper via a chain. The delay timer for delayed flushing of the toilet may include a timer mechanism, an external switch, and a retracting device. The external switch may be in communication with the timer mechanism. The retracting device may have a retractable line and may be in communication with the timer mechanism. The retractable line may be configured to be connected to a chain or a flapper in a tank of the toilet for flushing the toilet. Wherein, when the external switch is activated, the timer mechanism may be configured to delay a set period of time and then communicate with the retracting device to retract the retractable line to flush the toilet after the set period of time from when the external switch was activated.

In select embodiments of the toilet with delayed flushing, the timer mechanism and the retracting device may be housed in a control unit. The control unit may be configured to be positioned inside the tank of the toilet. In select embodiments, the control unit may be configured to be hung on a back inner wall of the tank of the toilet via at least one bracket. Each of the at least one brackets may include a hook portion. The hook portion may be connected to the control unit and may extend from an inside of the tank on the back inner wall of the tank, over a top of the tank beneath a lid of the tank, and down an outside of the tank on a back outer wall of the tank.

In select embodiments of the disclosed toilet with delayed flushing, external switch may communicate with the timer mechanism via a wire.

One feature of the disclosed toilet with delayed flushing may be that the external switch can include a lighted push button. The lighted push button may be configured to light up when pushed. This lighting up feature when pushed may be to verify the external switch has been pressed and the timer mechanism has begun delaying the set period of time to automatically flush the toilet.

In select embodiments of the disclosed toilet with delayed flushing, the external switch may be incorporated into a handle configured for flushing the toilet. The handle may include a conduit for connecting a wire from the external switch on a front of the handle through a pivot connection of the handle to a hole in the tank for connecting the handle. As such, the wire may extend from the external switch on the front of the handle, through the conduit in the handle and out of the pivot connection of the handle through the hole in the tank, to the inside of the tank and to the timer mechanism.

Another feature of the disclosed toilet with delayed flushing may be that the retractable line can include a clip. The clip may be positioned at a distal end of the retractable line. The clip may be configured to connect to a link of the chain connected to the flapper.

Another feature of the disclosed toilet with delayed flushing may be that the control unit can include a plastic housing. The plastic housing may be configured to seal the timer mechanism and the retracting device inside the control unit.

In select embodiments of the disclosed toilet with delayed flushing, the control unit may include batteries. The batteries may be configured for powering the timer mechanism and the retracting device.

In select embodiments of the disclosed toilet with delayed flushing, the retracting device may include a reel. The reel may be powered by an electric motor to retract the retractable line to flush the toilet. In select embodiments, the electric motor may also be configured to allow the retractable line to extend out from the reel of the retracting device after the toilet has been flushed.

Another feature of the disclosed toilet with delayed flushing may be that the timer mechanism can also be configured to automatically communicate to the retracting device to retract the line after a set frequency of flush, like once a day, once a week, once a month, the like, etc. Wherein, the delay timer of the toilet with delayed flushing may be configured for automatically flushing the toilet the set frequency of flush, including, but not limited to, being configured for automatically flushing the toilet once a day, once a week, once a month, the like, etc., or any other desired frequency of flush.

Another feature of the disclosed toilet with delayed flushing may be that the control unit may include a wireless communication device. The wireless communication device may be adapted to establish a wireless connection between the timer mechanism and a remote device, like a cell phone, tablet, computer, the like, etc. for wirelessly communicating with the remote device, like via Wi-Fi, Bluetooth®, cellular, the like, etc. communication. Whereby, the wireless communication device may allow a user to remotely flush the toilet and/or to program the delay timer for the desired set period of time and/or desired frequency of flush. The wireless communication device may also allow a user to monitor the delay timer.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
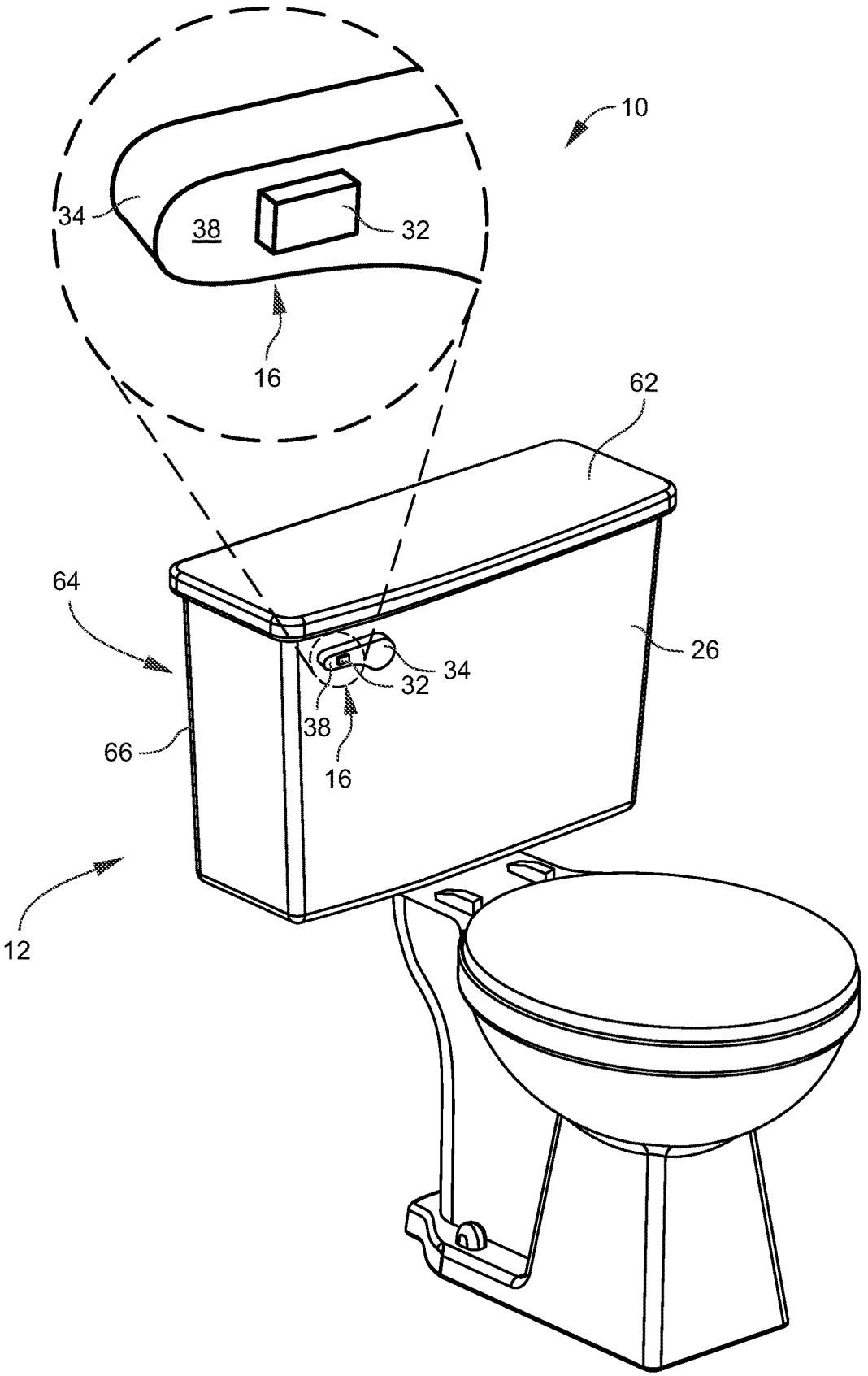
FIG. 1 is a perspective view of a toilet with the delay timer for the flushing of the toilet according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-7, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-6, in a possibly preferred embodiment, the present disclosure overcomes the above-mentioned disadvantages and meets the recognized need for such an apparatus or method by providing of delay timer 10 for the delayed flushing of a toilet 12. This delay timer 10 may be for delaying the flushing of toilet 12. As an example, and clearly not limited thereto, a user may desire to delay the flushing of toilet 12 during the middle of the night, or when someone is sleeping, like a baby, by using delay timer 10 to delay the flushing of toilet 12. As another example, and clearly not limited thereto, a user may desire to delay the flushing of toilet 12 to consolidate flushes and conserve water by using delay timer 10 to delay the flushing of toilet 12. Toilet 12 may be any type of flushable toilet, urinal, or the like. For purposes of delay timer 10, toilet 12 may include handle 34 for initiating the flushing of toilet 12, and tank 26 with chain 22 and flapper 24 for the internal flushing components of toilet 12. Delay timer 10 may be easily retrofitted into most standard toilets, urinals, or the like, like toilet 12 shown in FIGS. 1-5 and 7, by incorporating the components of delay timer 10 inside tank 26 and with handle 34. As an alternative, toilet 12 may be designed and built originally with delay timer 10. Delay timer 10 may generally include timer mechanism 14, external switch 16, and retracting device 18. These parts of delay timer 10 and their functions for delay timer 10 are described in greater detail below.

Timer mechanism 14 may be included with delay timer 10 for the delayed flushing of toilet 12. See FIGS. 1-7. Timer mechanism 14 may be for counting a set period of time for delaying the flushing of toilet 12 after the external switch has been activated. Timer mechanism 14 may include any clock, counter, timer, the like, etc. for counting the set period of time for delaying the flushing of toilet 12. The set period of time counted by timer mechanism 14 may be any desired set period of time, including, but not limited to, any desired seconds, minutes, hours, days, weeks, months, etc. Another feature of delay timer 10 for the delayed flushing of toilet 12 may be that timer mechanism 14 can also be configured to automatically communicate to retracting device 18 to retract retractable line 20 after a set frequency of flush, like once a day, once a week, once a month, the like, etc. Wherein, delay timer 10 may be configured for automatically flushing toilet 12 the set frequency of flush, including, but not limited to, being configured for automatically flushing the toilet once a day, once a week, once a month, the like, etc., or any other desired frequency of flush. This set frequency of flush feature may be advantageous for rental properties, basement bathrooms, guest bathrooms, or the like, where toilet 12 may go unused for an extended period of time. Whereby, this set frequency of flush feature may automatically flush toilet 12 every so often to make sure toilet 12 and its pipes do not freeze, to keep the toilet bowl clean of toilet 12 (prevent ugly toilet bowl ring), or for any other desired reasons to make sure toilet 12 is flushed every so often.

Figure 4:
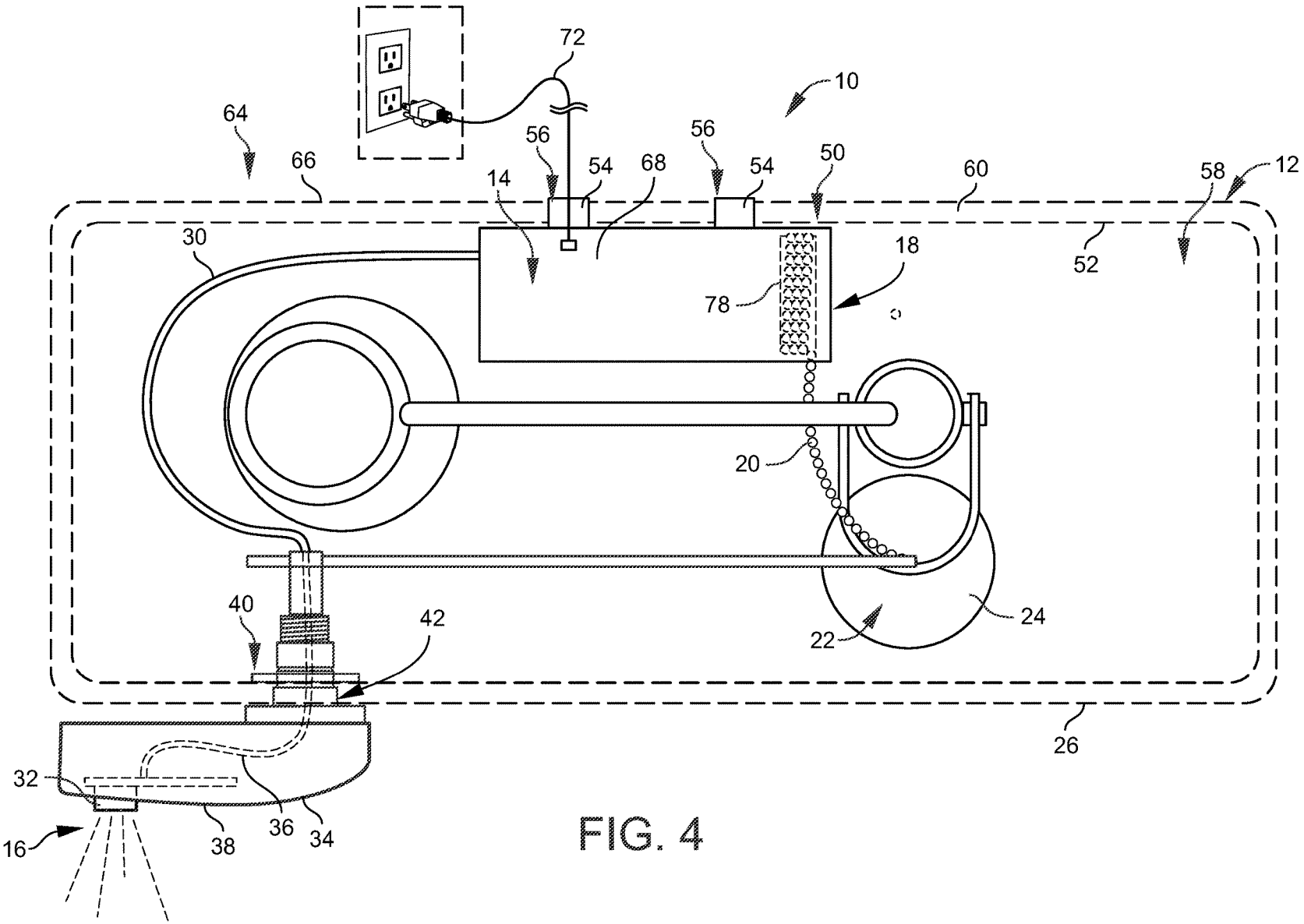
FIG. 4 is a top view of the tank from the toilet of FIG. 1 with the tank top removed to show the delay timer for the flushing of the toilet according to select embodiments of the instant disclosure.
Figure 5:
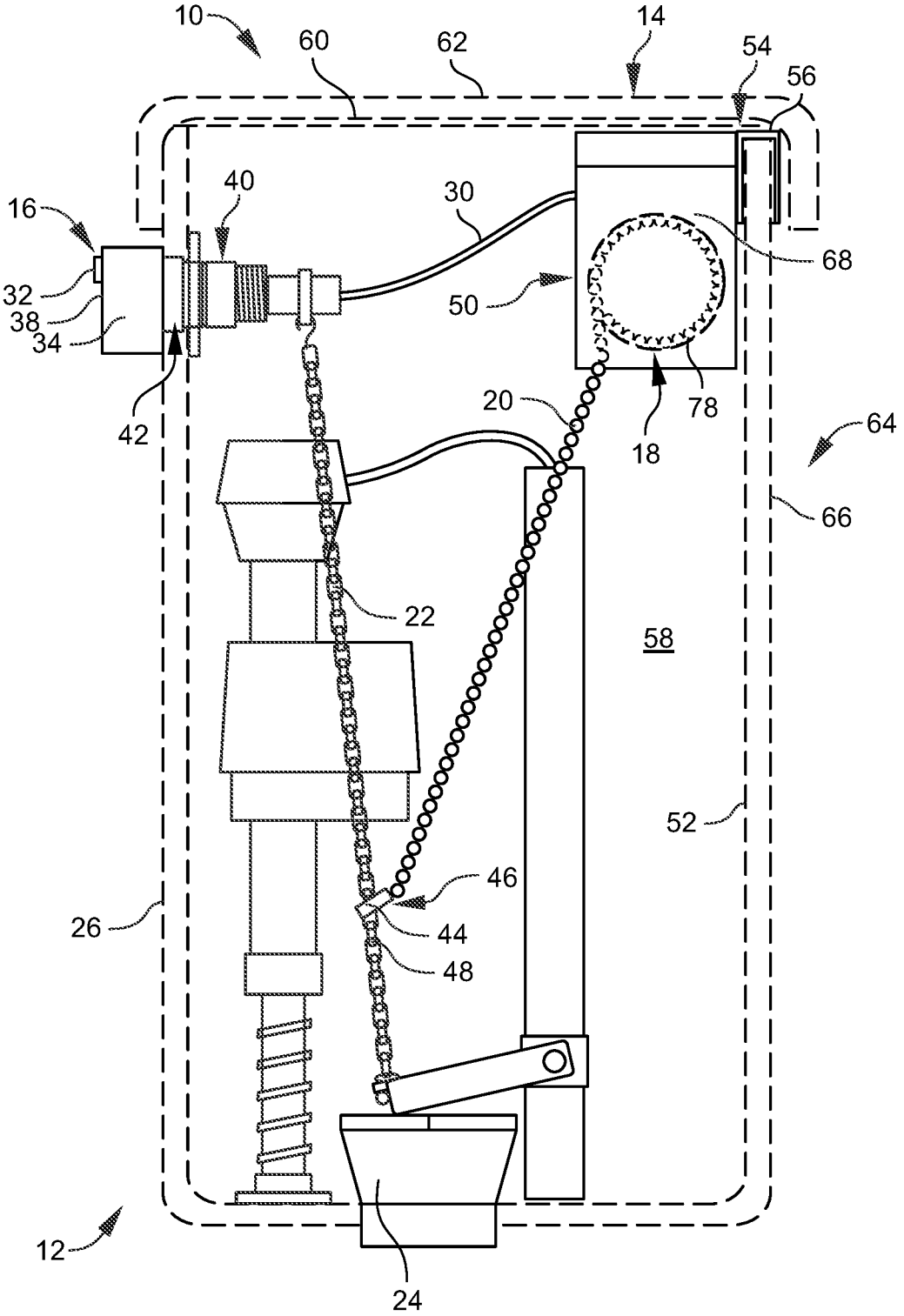
FIG. 5 is a side view of the tank from the toilet of FIG. 1 with the side of the tank broken away to show the delay timer for the flushing of the toilet according to select embodiments of the instant disclosure.
Figure 6:
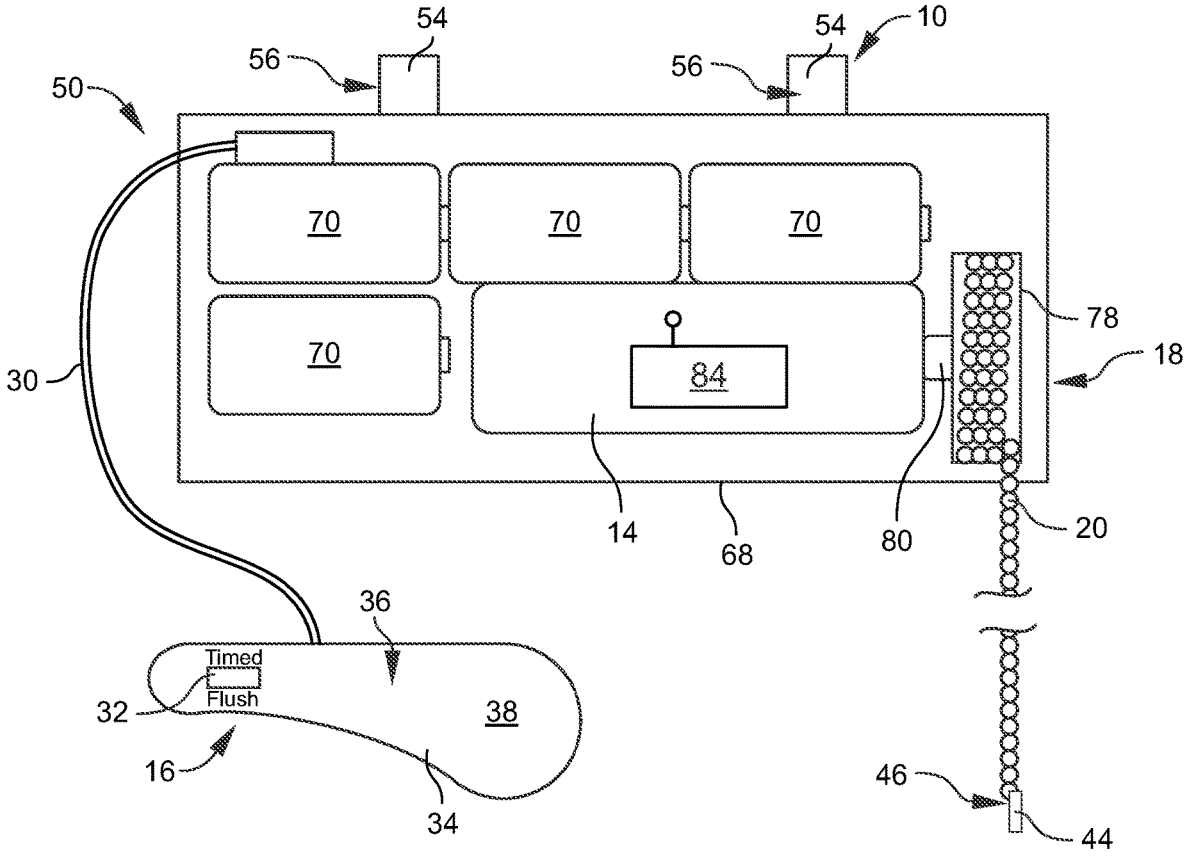
FIG. 6 is a schematic view of the delay timer for the flushing of the toilet according to select embodiments of the instant disclosure.

External switch 16 may be included with delay timer 10 for the delayed flushing of toilet 12. See FIGS. 1-7. External switch 16 may be for providing a means and device for activating delay timer 10 for starting the delayed flushing of toilet 12, where external switch 16 may be positioned on or around the outside of toilet 12. External switch 16 may be in communication with timer mechanism 14. External switch 16 may be in communication with timer mechanism 14 by any means, including any wired or wireless communication. In select embodiments, as shown in FIGS. 1-7, external switch 16 may be in communication with timer mechanism 14 via wire 30. One optional feature of delay timer 10 for delayed flushing of toilet 12 may be that external switch 16 can include lighted push button 32. Lighted push button 32 may be configured to light up when pushed by the user. This lighting up feature when lighted push button 32 is pushed may be to verify external switch 16 has been pressed and timer mechanism 14 has begun delaying the set period of time to automatically flush toilet 12. Lighted push button 32 may include any desired lighted functions for indicating the delayed flushing has begun, including, but not limited to, "Timed Flush" as shown in FIG. 6. External switch 16, including via lighted push button 32, may include some user interface or means for setting the set period of time for delaying the flushing of toilet 12. External switch 16 may be positioned anywhere, including anywhere on the outside of toilet 12 or around toilet 12. In select embodiments of delay timer 10 for delayed flushing of toilet 12, external switch 16 may be incorporated into handle 34, that may be configured for flushing of toilet 12. As best shown in FIGS. 2-4 and 7, handle 34 may include conduit 36 for connecting wire 30 from external switch 16 on front 38 of handle 34 through pivot connection 40 of handle 34 to hole 42 in tank 26 for connecting handle 34. As such, wire 30 may extend from external switch 16 on front 38 of handle 34, through conduit 36 in handle 34 and out of pivot connection 40 of handle 34 through hole 42 in tank 26, to inside 58 of tank 26 and to timer mechanism 14. As such, handle 34 may be a special handle with external switch 16 incorporated therein that may be easily retrofitted onto existing toilets or included in the design and building of a new toilet. Thus, delay timer 10 may include hardware to attach the flush handle 34.

Figure 2:
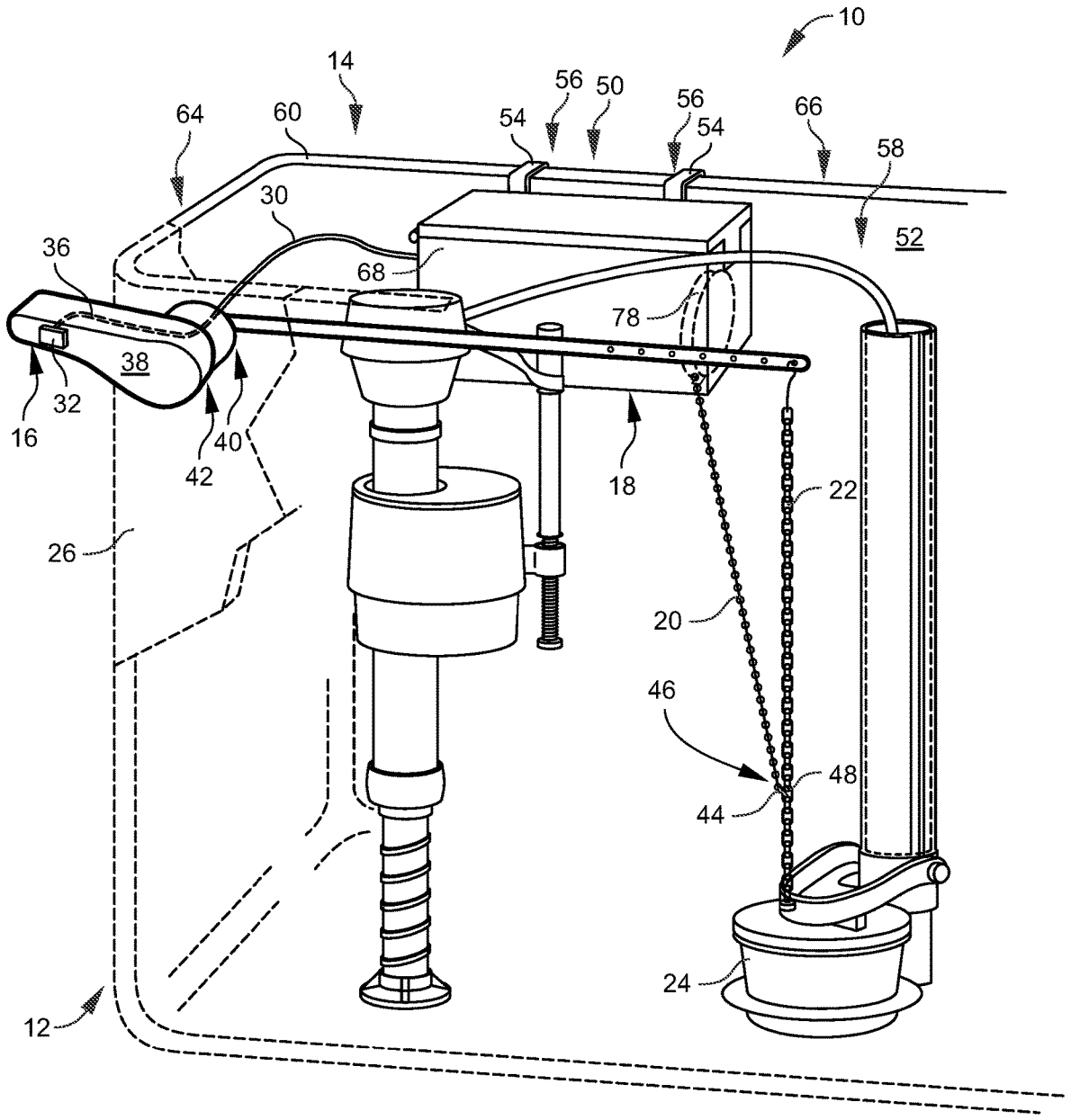
FIG. 2 is a perspective partially broken away view of the tank from the toilet of FIG. 1 showing the delay timer for the flushing of the toilet according to select embodiments of the instant disclosure.
Figure 3:
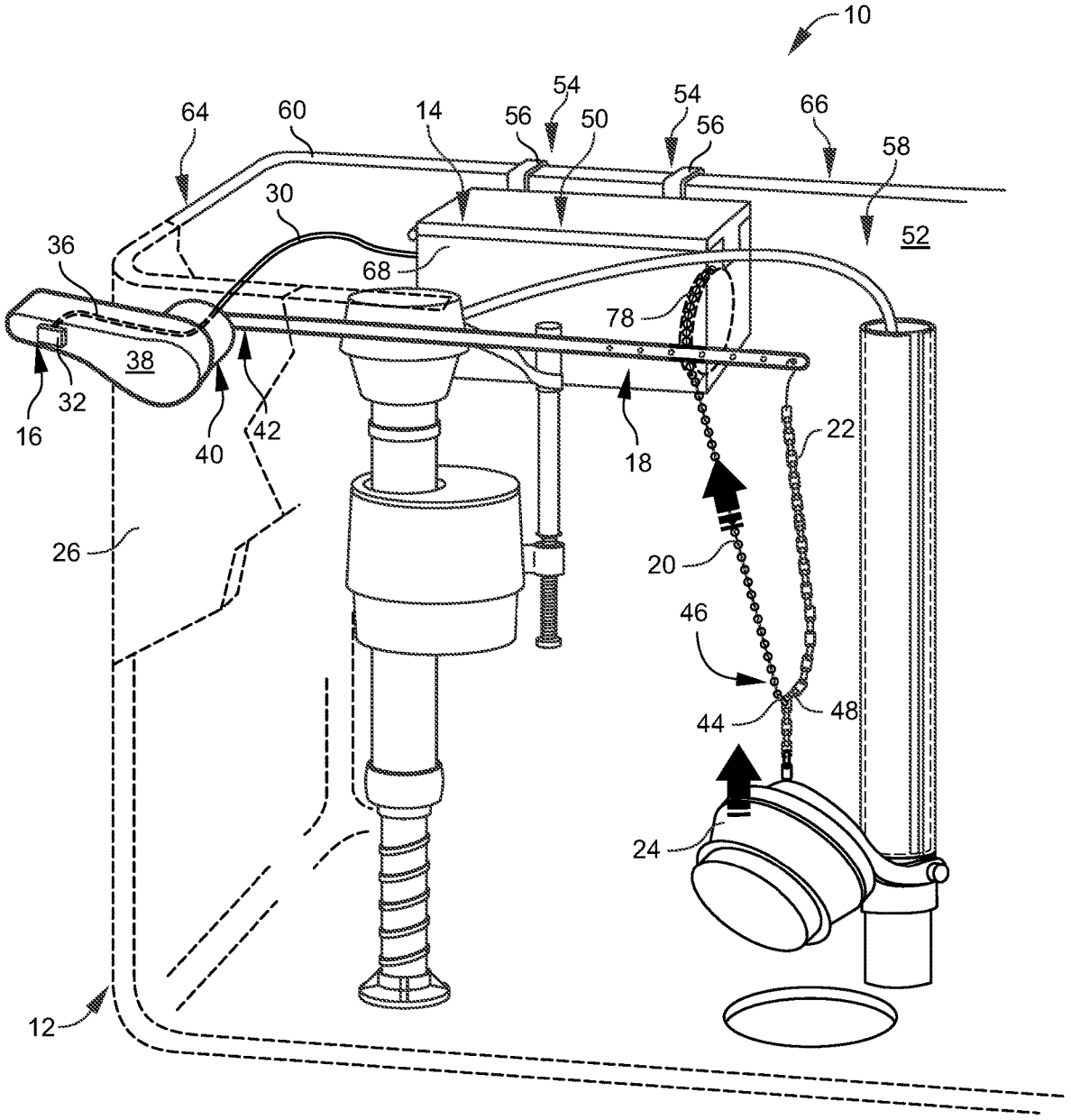
FIG. 3 is another perspective partially broken away view of the tank from the toilet of FIG. 1 showing the delay timer for the flushing of the toilet according to select embodiments of the instant disclosure in operation with the delay timer pulling up the flapper to flush the toilet.

Retracting device 18 may be included with delay timer 10 for the delayed flushing of toilet 12. See FIGS. 2-7. Retracting device 18 may be for lifting flapper 24 in tank 26 of toilet 12 after the desired delay for the delayed flushing of toilet 12. Retracting device 18 may be in communication with timer mechanism 14 for providing the operation of the delayed flushing of toilet 12. Retracting device 18 may be in communication with timer mechanism 14 by any wired or wireless communication, including, but not limited to being in communication via a circuit board, a wire, or the like. Retracting device 18 may lift or operate flapper 24 by any means. In select embodiments, as shown in FIGS. 2-6, retracting device 18 may have retractable line 20. Retractable line 20 may be for configured to attach to chain 22 and/or flapper 24 in tank 26 of toilet 12 for pulling up or lifting flapper 24 to provide the delayed flushing of toilet 12. Retracting device 18 may include any devices or means for pulling up or lifting flapper 24. In select embodiments of delay timer 10 for delayed flushing of toilet 12, retracting device 18 may include reel 78, as shown in FIGS. 2-6. Reel 78 may be powered by electric motor 80 to retract retractable line 20 to flush toilet 12 after the set period of time. After flushing, electric motor 80 may also be configured to allow retractable line 20 to extend out from reel 78 of retracting device 18 to allow flapper 24 to seal back in tank 26 after the delayed flushing of toilet 12. Retractable line 20 may be configured to be connected to chain 22 and/or flapper 24 in tank 26 of toilet 12 for the delayed flushing of toilet 12. In select embodiments of delay timer 10 for delayed flushing of toilet 12, retractable line 20 can include clip 44. Clip 44 may be designed and configured for easy connection to a link 48 of chain 22 (as shown in FIGS. 2-3 and 5) and/or directly to flapper 24. Clip 44 may be positioned at distal end 46 of retractable line 20. As shown in FIGS. 2-3 and 5, in select embodiments, clip 44 may be configured to connect to link 48 of chain 22 connected to flapper 24. This configuration of retractable line 20 connected to link 48 of chain 22 may allow for the normal operation of flapper 24 via the rotation of handle 34 and the lifting of chain 22 via the handle lever arm for immediate flushing of toilet 12, while at the same time allowing delay timer 10 to operate delayed flushing of toilet 12 via retracting device 18 lifting flapper 24 via clip 44 on link 48 of chain 22. As such, incorporating delayed timer 10 into toilet 12 may not destroy the normal operation of immediate flushing of toilet 12 via handle 34 but gives the user an option to either immediately flush via handle 34 or delay flushing of toilet 12 via external switch 16, like lighted push button 32 on front 38 of handle 34.

Figure 7:
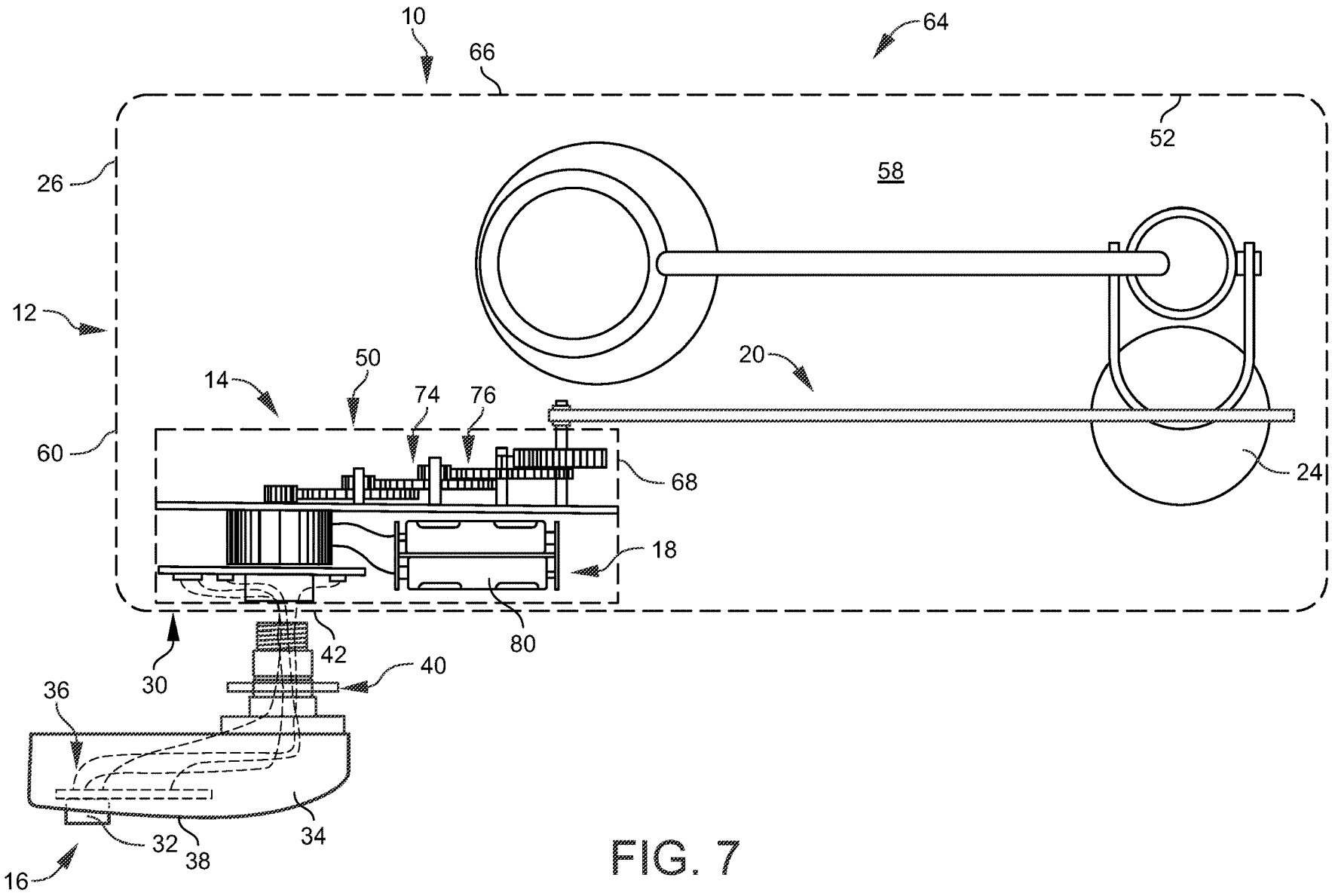
FIG. 7 is a top view of the tank with the delay timer for the flushing of the toilet according to select embodiments of the instant disclosure with the tank top removed to show the delay timer with the retractable device being a counterweight and gear system.

Control unit 50 may be included with delay timer 10 for delayed flushing of toilet 12. See FIGS. 1-7. Control unit 50 may be for housing timer mechanism 14 and retracting device 18. Control unit 50 may be configured to be positioned inside tank 26 of toilet 12. Control unit 50 may be positioned or mounted anywhere inside or around tank 26 of toilet 12. In select embodiments, as best shown in FIGS. 2-5, control unit 50 may be configured to be hung on back inner wall 52 of tank 26 of toilet 12 via at least one bracket 54, like 2 brackets 54, as shown in FIGS. 2-5. Each of the brackets 54 may include hook portion 56. The hook portion 56 of each of the brackets 54 may be connected to control unit 50 and may extend from inside 58 of tank 26 on back inner wall 52 of tank 26, over top 60 of tank 26 beneath lid 62 of tank 26, and down outside 64 of tank 26 on back outer wall 66 of tank 26. This hook portion 56 of brackets 54 may thus be configured to hang control unit 50 on back inner wall 52 in tank 26 of toilet 12. Thus, control unit 50 may be easily retrofitted into an existing toilet 12. Control unit 50 may be made out of any desired materials and may be configured in any desired shape for housing timer mechanism 14 and retracting device 18. In select embodiments, control unit 50 can include plastic housing 68. Plastic housing 68 may be configured to seal timer mechanism 14 and retracting device 18 inside control unit 50. Plastic housing 68 may include a removable top for accessing timer mechanism and/or retracting device 18 for maintenance, replacement, inspection, or the like. The removable top may include any seals configured for sealing the top to the rest of plastic housing 68. Control unit 50 may include means for powering timer mechanism 14 and retracting device 18. As shown in FIG. 6, in select embodiments of delay timer 10 for delayed flushing of toilet 12, control unit 50 may include batteries 70. Batteries 70 may be configured for powering timer mechanism 14, retracting device 18, and any or all of the components of delay timer 10. As shown in FIG. 4, in other select other embodiments of delay timer 10 for delayed flushing of toilet 12, control unit 50 may include wired power source 72. Wired power source 72 may be configured for powering timer mechanism 14, retracting device 18, and any or all of the components of delay timer 10. As shown in FIG. 7, in select other embodiments of delay timer 10 for delayed flushing of toilet 12, control unit 50 may include counterweights 74. Counterweights 74 may be configured for powering timer mechanism 14, retracting device 18, and any or all of the components of delay timer 10 via flow of the water entering tank 26 of toilet 12 to spin gear system 76. As such, the mechanical energy of gears 76 or counterweight 74 may be used to create the delay of the set period of time of timer mechanism 14. In select embodiments of control unit 50, wireless communication device 84 may be included. See FIG. 6. Wireless communication device 84 may be adapted to establish a wireless connection between timer mechanism 14 and a remote device, like a cell phone, tablet, computer, the like, etc. for wirelessly communicating with the remote device, like via Wi-Fi, Bluetooth®, cellular, the like, etc. communication. Whereby, wireless communication device 84 may allow a user to remotely flush toilet 12 and/or to program delay timer 10 for the desired set period of time and/or desired frequency of flush. In addition, wireless communication device 84 may also allow a user to monitor delay timer 10, like monitoring when toilet 12 is flushed and/or the frequency that toilet 12 is flushed. As such, the instant disclosure contemplates a phone/tablet application, website, computer software, the like, etc. that provides a user interface for allowing the user to remotely flush toilet 12, program delay timer 10 for the desired set period of time and/or desired frequency of flush, and/or to monitor when toilet 12 is flushed and/or the frequency that toilet 12 is flushed.

In operation, when external switch 16 is activated, timer mechanism 14 may be configured to delay a set period of time and then communicate with retracting device 18 to retract retractable line 20 to flush toilet 12 after the set period of time from when external switch 16 was activated.

In another aspect, the instant disclosure embraces delay timer 10 for the delayed flushing of toilet 12 including any various embodiments or combination of embodiments shown and/or described herein, including the combination of all elements or embodiments shown and/or described herein.

In another aspect, the instant disclosure embraces toilet 12 with delay timer 10 for the delayed flushing of toilet 12 disclosed herein. Toilet 12 may include any of the various embodiments of delay timer 10 for the delayed flushing of toilet 12 described and/or shown herein.

In sum, currently there are no toilets or products that allow the user to delay the flushing process of a toilet, urinal, the like, etc. All of the current flushing switches and mechanisms allow for an immediate flush only, without a delay. The present disclosure is directed to delaying the flushing of toilet 12 for a set period of time. The user will have the option to allow the device to automatically flush the toilet after a delay. The unit may be powered by batteries 70 and may have lighted push button switch 32 installed on flushing handle 34 in order to verify its use.

As a result, delay timer 10 for the flushing of toilet 12 may allow the user of toilet 12 to delay the flushing of toilet 12 for a set period of time. Delay timer 10 may be installed inside of the toilet water tank 26, by brackets 54 that go over the back of tank 26. Delay timer 10 may be controlled by external switch 16 on flushing handle 34.

In use, delay timer 10 for the flushing of toilets will allow an electrically powered timer mechanism 14 and reel 78 with electric motor 80 to flush toilet 12 after a set period of time.

Alternate designs of delay timer 10 may be one that use wired power source 72 or the power of the water entering the toilet tank to spin gear system 76 or fill counterweight 74, where the mechanical energy of gears 76 or counterweight 74 could be used to create the effect of a timer.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. A delay timer for delayed flushing of a toilet comprising:

a timer mechanism;

an external switch in communication with the timer mechanism;

a retracting device with a retractable line, the retracting device is in communication with the timer mechanism, the retractable line is configured to be connected to a chain or a flapper in a tank of the toilet for flushing the toilet;

wherein, when the external switch is activated, the timer mechanism is configured to delay a set period of time and then communicate with the retracting device to retract the retractable line to flush the toilet after the set period of time from when the external switch was activated.

2. The delay timer for delayed flushing of a toilet of claim 1, wherein the external switch communicates with the timer mechanism via a wire.

3. The delay timer for delayed flushing of a toilet of claim 1, wherein the external switch includes a lighted push button configured to light up when pushed to verify the external switch has been pressed and the timer mechanism has begun delaying the set period of time to automatically flush the toilet.

4. The delay timer for delayed flushing of a toilet of claim 1, wherein the external switch is incorporated into a handle configured for flushing the toilet, wherein the handle including a conduit for connecting a wire from the external switch on a front of the handle through a pivot connection of the handle to a hole in the tank for connecting the handle, where the wire extends from the external switch on the front of the handle, through the conduit in the handle and out of the pivot connection of the handle through the hole in the tank, to an inside of the tank and to the timer mechanism.

5. The delay timer for delayed flushing of a toilet of claim 1, wherein the retractable line including a clip at a distal end configured to connect to a link of the chain.

6. The delay timer for delayed flushing of a toilet of claim 1, wherein the timer mechanism and the retracting device are housed in a control unit, the control unit is configured to be positioned inside the tank of the toilet.

7. The delay timer for delayed flushing of a toilet of claim 6, wherein the control unit is configured to be hung on a back inner wall of the tank of the toilet via at least one bracket.

8. The delay timer for delayed flushing of a toilet of claim 7, wherein each of the at least one bracket includes a hook portion that connects to the control unit and extends from an inside of the tank on the back inner wall of the tank, over a top of the tank beneath a lid of the tank, and down an outside of the tank on a back outer wall of the tank.

9. The delay timer for delayed flushing of a toilet of claim 6 wherein the control unit includes a plastic housing configured to seal the timer mechanism and the retracting device inside the control unit.

10. The delay timer for delayed flushing of a toilet of claim 6, wherein the control unit including batteries configured for powering the timer mechanism and the retracting device.

11. The delay timer for delayed flushing of a toilet of claim 6, wherein the control unit including a wired power source configured for powering the timer mechanism and the retracting device.

12. The delay timer for delayed flushing of a toilet of claim 6, wherein the control unit including a counterweight configured to power the timer mechanism and the retracting device via flow of water entering the tank of the toilet to spin a gear system, wherein mechanical energy of the gears or the counterweight are used to create the delay of the set period of time of the timer mechanism.

13. The delay timer for delayed flushing of a toilet of claim 1, wherein the retracting device including:

a reel with an electric motor configured for powering the reel to retract the retractable line to flush the toilet.

14. The delay timer for delayed flushing of a toilet of claim 13, wherein the electric motor is also configured to allow the retractable line to extend out from the reel of the retracting device after the toilet has been flushed.

15. The delay timer for delayed flushing of a toilet of claim 1, wherein the timer mechanism is also configured to automatically communicate to the retracting device to retract the line after a set frequency of flush, wherein the delay timer is configured for automatically flushing the toilet the set frequency of flush.

16. The delay timer for delayed flushing of a toilet of claim 1 further including a wireless communication device, where the wireless communication device is adapted to establish a wireless connection between the timer mechanism and a remote device for wirelessly communicating with the remote device, whereby, the wireless communication device allows a user to remotely flush the toilet, to program the delay timer for a desired set period of time or a desired frequency of flush, and the wireless communication device is configured to allow a user to monitor the delay timer and the flushing of the toilet.

17. A delay timer for delayed flushing of a toilet comprising:

a control unit including a timer mechanism and a retracting device, the control unit is configured to be positioned inside a tank of the toilet, the control unit is configured to be hung on a back inner wall of the tank of the toilet via at least one bracket, each of the at least one bracket includes a hook portion that connects to the control unit and extends from an inside of the tank on the back inner wall of the tank, over a top of the tank beneath a lid of the tank, and down an outside of the tank on a back outer wall of the tank, the control unit including batteries configured for powering the timer mechanism and the retracting device; the control unit includes a plastic housing configured to seal the timer mechanism, the retracting device, and the batteries inside the control unit;

an external switch in communication with the timer mechanism in the control unit, the external switch communicates with the timer mechanism in the control unit via a wire;

the retracting device is in communication with the timer mechanism, the retracting device including a retractable line, the retractable line including a clip at a distal end configured to connect to a link of a chain, the retracting device including a reel with an electric motor configured for powering the reel to retract the retractable line to flush the toilet, the electric motor is also configured to allow the retractable line to extend out from the reel of the retracting device after the toilet has been flushed;

wherein, when the external switch is activated, the timer mechanism is configured to delay a set period of time and then communicate with the retracting device to retract the retractable line to flush the toilet after the set period of time from when the external switch was activated;

the external switch includes a lighted push button configured to light up when pushed to verify the external switch has been pressed and the timer mechanism has begun delaying the set period of time to automatically flush the toilet;

the external switch is incorporated into a handle configured for flushing the toilet, wherein the handle including a conduit for connecting the wire from the external switch on a front of the handle through a pivot connection of the handle to a hole in the tank for connecting the handle, where the wire extends from the external switch on the front of the handle, through the conduit in the handle and out of the pivot connection of the handle through the hole in the tank, to the inside of the tank and to the timer mechanism;

wherein, the timer mechanism is also configured to automatically communicate to the retracting device to retract the line after a set frequency of flush, wherein the delay timer is configured for automatically flushing the toilet the set frequency of flush; and a wireless communication device, where the wireless communication device is adapted to establish a wireless connection between the timer mechanism and a remote device for wirelessly communicating with the remote device, whereby, the wireless communication device allows a user to remotely flush the toilet, to program the delay timer for the desired set period of time or the desired frequency of flush, and the wireless communication device is configured to allow a user to monitor the delay timer and the flushing of the toilet.

18. A toilet with delayed flushing comprising:

a tank with a handle, and a lever in communication with the handle for raising a flapper via a chain;

a delay timer for delayed flushing of the toilet comprising:

a timer mechanism;

an external switch in communication with the timer mechanism;

a retracting device with a retractable line in communication with the timer mechanism, the retractable line is configured to be connected to the chain or the flapper in the tank of the toilet for flushing the toilet;

wherein, when the external switch is activated, the timer mechanism is configured to delay a set period of time and then communicate with the retracting device to retract the retractable line to flush the toilet after the set period of time from when the external switch was activated.

19. The toilet of claim 18 further including a control unit housing the timer mechanism and the retractable device, the control unit is positioned inside the tank of the toilet, where the control unit is hung on a back inner wall of the tank of the toilet via at least one bracket, each of the at least one bracket includes a hook portion that connects to the control unit and extends from an inside of the tank on the back inner wall of the tank, over a top of the tank beneath a lid of the tank, and down an outside of the tank on a back outer wall of the tank.

20. The toilet of claim 19, wherein:

the external switch communicates with the timer mechanism in the control unit via a wire;

the external switch includes a lighted push button configured to light up when pushed to verify the external switch has been pressed and the timer mechanism has begun delaying the set period of time to automatically flush the toilet;

the external switch is incorporated into the handle configured for flushing the toilet;

the handle including a conduit for connecting the wire from the external switch on a front of the handle through a pivot connection of the handle to a hole in the tank for connecting the handle, where the wire extends from the external switch on the front of the handle, through the conduit in the handle and out of the pivot connection of the handle through the hole in the tank, to the inside of the tank and to the timer mechanism inside the control unit;

the retractable line including a clip at a distal end configured to connect to a link of the chain;

the control unit includes a plastic housing configured to seal the timer mechanism and the retracting device inside the control unit;

the control unit includes batteries configured for powering the timer mechanism and the retracting device;

the retracting device including a reel with an electric motor configured for powering the reel to retract the retractable line to flush the toilet;

the electric motor is also configured to allow the retractable line to extend out from the reel of the retracting device after the toilet has been flushed;

the timer mechanism is also configured to automatically communicate to the retracting device to retract the line after a set frequency of flush, wherein the delay timer is configured for automatically flushing the toilet the set frequency of flush;

a wireless communication device, where the wireless communication device is adapted to establish a wireless connection between the timer mechanism and a remote device for wirelessly communicating with the remote device, whereby, the wireless communication device allows a user to remotely flush the toilet, to program the delay timer for a desired set period of time or a desired frequency of flush, and the wireless communication device is configured to allow a user to monitor the delay timer and the flushing of the toilet;

or combinations thereof.

* * * * *